US007856822B2

(12) United States Patent
Schoell

(10) Patent No.: US 7,856,822 B2
(45) **Date of Patent: *Dec. 28, 2010**

(54) HEAT REGENERATIVE ENGINE

(75) Inventor: Harry Schoell, Pompano Beach, FL (US)

(73) Assignee: Cyclone Power Technologies, Inc., Pompano Beach, FL (US)

( * ) Notice: Subject to any disclaimer, the term of this patent is extended or adjusted under 35 U.S.C. 154(b) by 1188 days.

This patent is subject to a terminal disclaimer.

(21) Appl. No.: 11/489,335

(22) Filed: Jul. 19, 2006

(65) Prior Publication Data

US 2006/0254278 A1 Nov. 16, 2006

Related U.S. Application Data

(63) Continuation of application No. 11/225,422, filed on Sep. 13, 2005, now Pat. No. 7,080,512.

(60) Provisional application No. 60/609,725, filed on Sep. 14, 2004.

(51) Int. Cl.
*F01K 7/34* (2006.01)

(52) U.S. Cl. ..... 60/653; 60/671; 60/677

(58) Field of Classification Search ..... 60/653, 60/670, 671, 677

See application file for complete search history.

(56) References Cited

U.S. PATENT DOCUMENTS 1,636,887 A * 7/1927 Windell ..... 60/514
5,191,858 A * 3/1993 McWhorter ..... 123/21
7,080,512 B2 * 7/2006 Schoell ..... 60/670

* cited by examiner

*Primary Examiner*—Hoang M Nguyen
(74) *Attorney, Agent, or Firm*—Robert M. Downey, P.A.

(57) ABSTRACT

A heat regenerative engine uses water as both the working fluid and the lubricant. In operation, water is pumped from a collection pan and through a coil around a cylinder exhaust port, causing the water to be preheated by steam exhausted from the cylinder. The preheated water then enters a steam generator and is heated by a combustion chamber to produce high pressure super heated steam. Air is preheated in a heat exchanger and is then mixed with fuel from a fuel atomizer. An igniter burns the atomized fuel as the flames and heat are directed in a centrifuge within the combustion chamber. The speed and torque of the engine are controlled by a rocker and cam arrangement which opens a needle-type valve to inject high pressure super heated steam into a cylinder having a reciprocating piston therein. The injected steam expands in an explosive action on the top of the piston at high pressure forcing the piston down and drivingly rotating a linked crank cam and crankshaft. Exhaust steam is directed through a centrifugal condenser having an arrangement of flat plates. Cooling air from blowers circulates through the flat plates to condense the steam to a liquid state. The water condensation is returned to the collection pan for subsequent use in steam generation.

12 Claims, 13 Drawing Sheets

TOP VIEW

BOTTOM VIEW

HEAT REGENERATIVE ENGINE

BACKGROUND OF THE INVENTION

This application is a continuation application of Co-pending patent application Ser. No. 11/225,422 filed on Sep. 13, 2005, now U.S. Pat. No. 7,080,512, which claimed the benefit of provisional patent application Ser. No. 60/609,725 filed on Sep. 14, 2004.

FIELD OF THE INVENTION

The present invention is directed to a steam engine and, more particularly, to a heat regenerative engine which uses water as the working fluid, as well as the lubricant, and wherein the engine is highly efficient, environmentally friendly and adapted for multi-fuel use.

DISCUSSION OF THE RELATED ART

Environmental concerns have prompted costly, complex technological proposals in engine design. For instance, fuel cell technology provides the benefit of running on clean burning hydrogen. However, the expense and size of fuel cell engines, as well as the cost of creating, storing, and delivering fuel grade hydrogen disproportionately offsets the environmental benefits. As a further example, clean running electric vehicles are limited to very short ranges, and must be regularly recharged by electricity generated from coal, diesel or nuclear fueled power plants. And, while gas turbines are clean, they operate at constant speed. In small sizes, gas turbines are costly to build, run and overhaul. Diesel and gas internal combustion engines are efficient, lightweight and relatively inexpensive to manufacture, but they produce a significant level of pollutants that are hazardous to the environment and the health of the general population and are fuel specific.

The original Rankin Cycle Steam Engine was invented by James Watt over 150 years ago. Present day Rankin Cycle Steam Engines use tubes to carry super heated steam to the engine and, thereafter, to a condenser. The single tubes used to pipe super heated steam to the engine have a significant exposed surface area, which limits pressure and temperature levels. The less desirable lower pressures and temperatures, at which water can easily change state between liquid and gas, requires a complicated control system. While Steam Engines are generally bulky and inefficient, they tend to be environmentally clean. Steam Engines have varied efficiency levels ranging from 5% on older model steam trains to as much as 45% in modern power plants. In contrast, two-stroke internal combustion engines operate at approximately 17% efficiency, while four-stroke internal combustion engines provide efficiency up to approximately 25%. Diesel combustion engines, on the other hand, provide as much as 35% engine efficiency.

OBJECTS AND ADVANTAGES OF THE INVENTION

With the foregoing in mind, it is a primary object of the present invention to provide an engine that which is compact and which operates at high efficiency.

It is a further object of the present invention to provide a compact and highly efficient engine which provides for heat regeneration and which operates at or near super critical pressure (3,200 lbs.) and high temperature (1,200 degrees Fahrenheit).

It is still a further object of the present invention to provide a highly efficient and compact engine which is environmentally friendly, using external combustion, a cyclone burner and water lubrication.

It is still a further object of the present invention to provide a compact and highly efficient steam engine which has multi-fuel capacity, allowing the engine to burn any of a variety of fuel sources and combinations thereof.

It is yet a further object of the present invention to provide a compact and highly efficient steam engine which is lightweight, with no separate water cooling system and which produces no vibration and no exhaust noise.

It is still a further object of the present invention to provide a compact and highly efficient steam engine which requires no transmission.

These and other objects and advantages of the present invention are more readily apparent with reference to the detailed description and accompanying drawings.

SUMMARY OF THE INVENTION

The present invention is directed to a compact and highly efficient engine which uses water as the working fluid, as well as the lubricant. The engine consists primarily of a condenser, a steam generator and a main engine section having valves, cylinders, pistons, pushrods, a main bearing, cams and a camshaft. Ambient air is introduced into the condenser by intake blowers. The air temperature is increased in two phases before entering a cyclone furnace. In the first phase, air enters the condenser from the blowers. In the next phase, the air is directed from the condenser and through heat exchangers where the air is heated prior to entering the steam generator. In the steam generator, the preheated air is mixed with fuel from a fuel atomizer. The burner burns the fuel atomized in a centrifuge, causing the heavy fuel elements to move towards the outer sides of the furnace where they are consumed. The hotter, lighter gasses move through a small tube bundle. The cylinders of the engine are arranged in a radial configuration with the cylinder heads and valves extending into the cyclone furnace. Temperatures in the tube bundle are maintained at 1,200 degrees Fahrenheit. The tube bundle, carrying the steam, is directed through the furnace and exposed to the high temperatures. In the furnace, the steam is super heated and maintained at a pressure up to approximately 3,200 lbs.

Exhaust steam is directed through a primary coil which also serves to preheat the water in the generator. The exhaust steam is then directed through a condenser, in a centrifugal system of compressive condensation, consisting of a stacked arrangement of flat plates. Cooling air circulates through the flat plates, is heated in an exhaust heat exchanger and exits into the furnace. This reheat cycle of air greatly adds to the efficiency and compactness of the engine.

The speed and torque of the engine are controlled by a rocker and cam design which serves to open and close a needle type valve in the engine head. When the valve is opened, high pressure, high temperature steam is injected into the cylinder and allowed to expand as an explosion on the top of the piston high pressure. Use of three or more pistons allows for self-starting.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
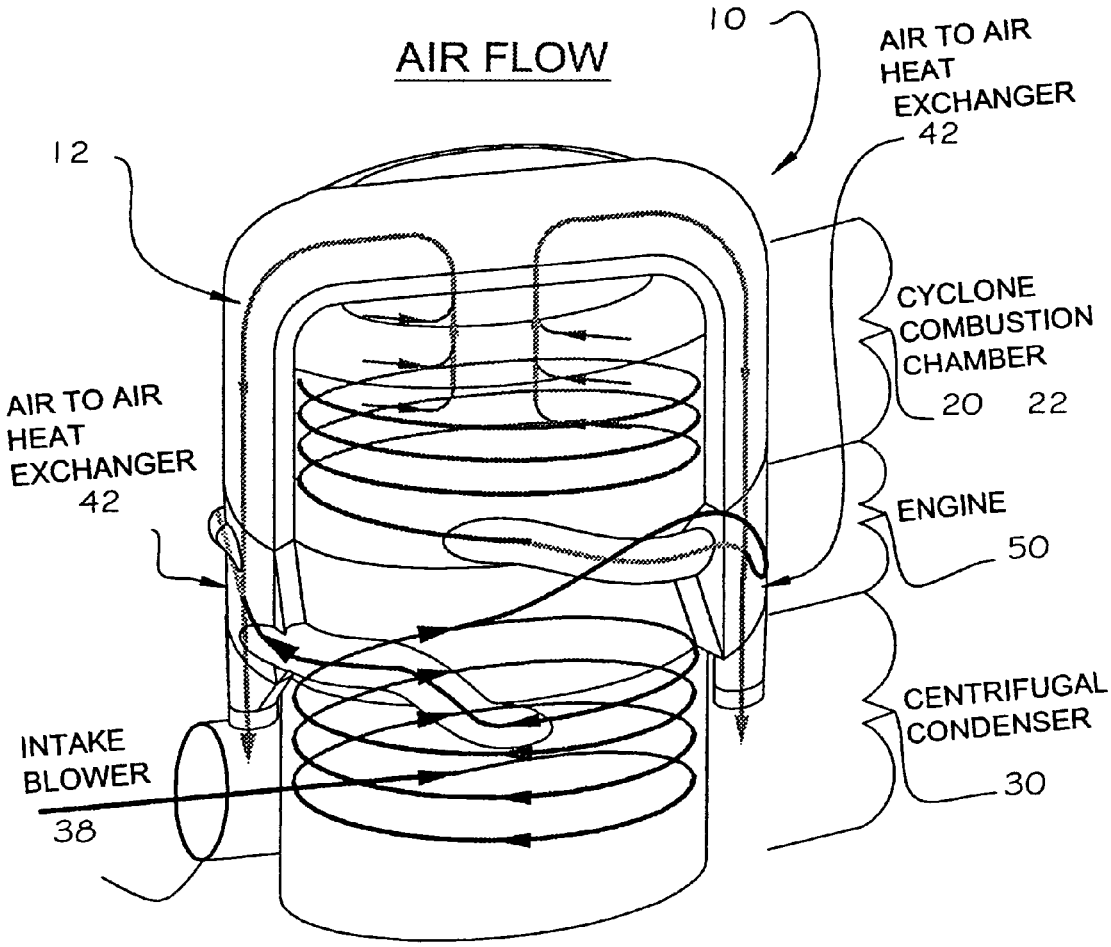
FIG. 1 is a general diagram illustrating air flow through the engine of the present invention.
Figure 2:
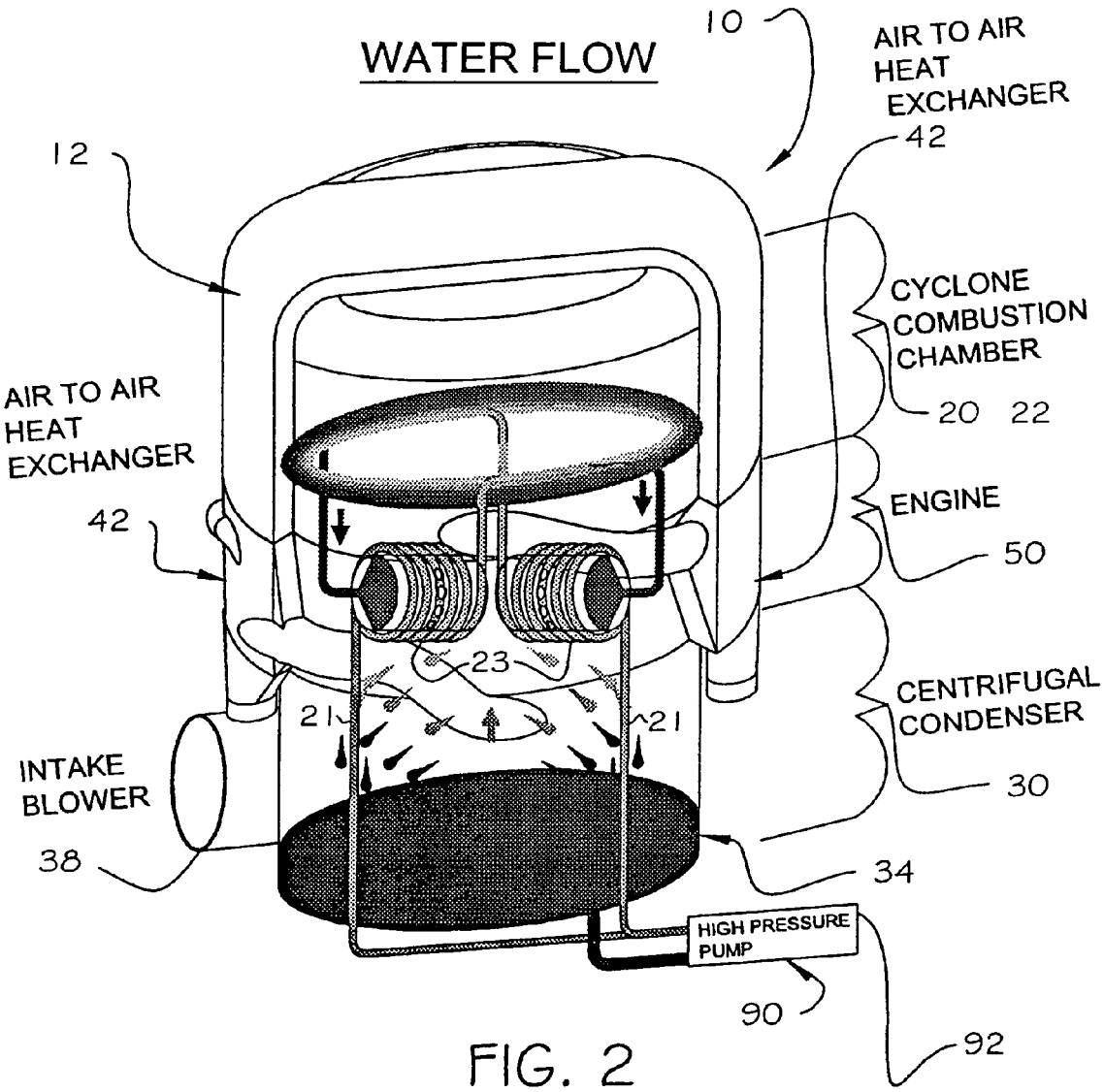
FIG. 2 is a general diagram illustrating water and steam flow through the engine.

The present invention is directed to a radial steam engine and is generally indicated as 10 throughout the drawings. Referring initially to FIGS. 1 and 2, the engine 10 includes a steam generator 20, a condenser 30 and a main engine section 50 comprising cylinders 52, valves 53, pistons 54, push-rods 74, crank cam 61 and a crankshaft 60 extending axially through a center of the engine section.

In operation, ambient air is introduced into the condenser 30 by intake blowers 38. The air temperature is increased in two phases before entering a cyclone furnace 22 (referred to hereafter as "combustion chamber"). The condenser 30 is a flat plate dynamic condenser with a stacked arrangement of flat plates 31 surrounding an inner core. This structural design of the dynamic condenser 30 allows for multiple passes of steam to enhance the condensing function. In a first phase, air enters the condenser 30 from the blowers 38 and is circulated over the condenser plates 31 to cool the outer surfaces of the plates and condense the exhaust steam circulating within the plates. More particularly, vapor exiting the exhaust ports 55 of the cylinders 52 passes through the pre-heating coils surrounding the cylinders. The vapor drops into the core of the condenser where centrifugal force from rotation of the crankshaft drives the vapor into the inner cavities of the condenser plates 31. As the vapor changes phase into a liquid, it enters sealed ports on the periphery of the condenser plates. The condensed liquid drops through collection shafts and into the sump 34 at the base of the condenser. A high pressure pump 92 returns the liquid from the condenser sump 34 to the coils 24 in the combustion chamber, completing the fluid cycle of the engine. The stacked arrangement of the condenser plates 31 presents a large surface area for maximizing heat transfer within a relatively compact volume. The centrifugal force of the crankshaft impeller that repeatedly drives the condensing vapor into the cooling plates 31, combined with the stacked plate design, provides a multi-pass system that is far more effective than conventional condensers of single-pass design.

The engine shrouding 12 is an insulated cover that encloses the combustion chamber and piston assembly. The shroud 12 incorporates air transfer ducts 32 that channel air from the condenser 30, where it has been preheated, to the intake portion of air-to-air heat exchangers 42, where the air is further heated. Exiting the heat exchangers 42, this heated intake air enters the atomizer/igniter assemblies in the burner 40 where it is combusted in the combustion chamber. The shroud also includes return ducts that capture the combustion exhaust gases at the top center of the combustion chamber, and leads these gases back through the exhaust portion of the air-to-air heat exchangers 42. The engine shrouding adds to the efficiency and compactness of the engine by conserving heat with its insulation, providing necessary ductwork for the airflow of the engine, and incorporating heat exchangers that harvest exhaust has heat.

Water in its delivery path from the condenser sump pump to the combustion chamber is pumped via through one or more main steam supply lines 21 for each cylinder. The main steam line 21 passes through a pre-heating coil 23 that is wound around each cylinder skirt adjacent to that cylinder's exhaust ports. The vapor exiting the exhaust ports gives up heat to this coil, which raises the temperature of the water being directed through the coil toward the combustion chamber. Reciprocally, in giving up heat to the preheating coils, the exhaust vapor begins the process of cooling on its path through these coils preparatory to entering the condenser. The positioning of these coils adjacent to the cylinder exhaust ports scavenges heat that would otherwise be lost to the system, thereby contributing to the overall efficiency of the engine.

Figure 3:
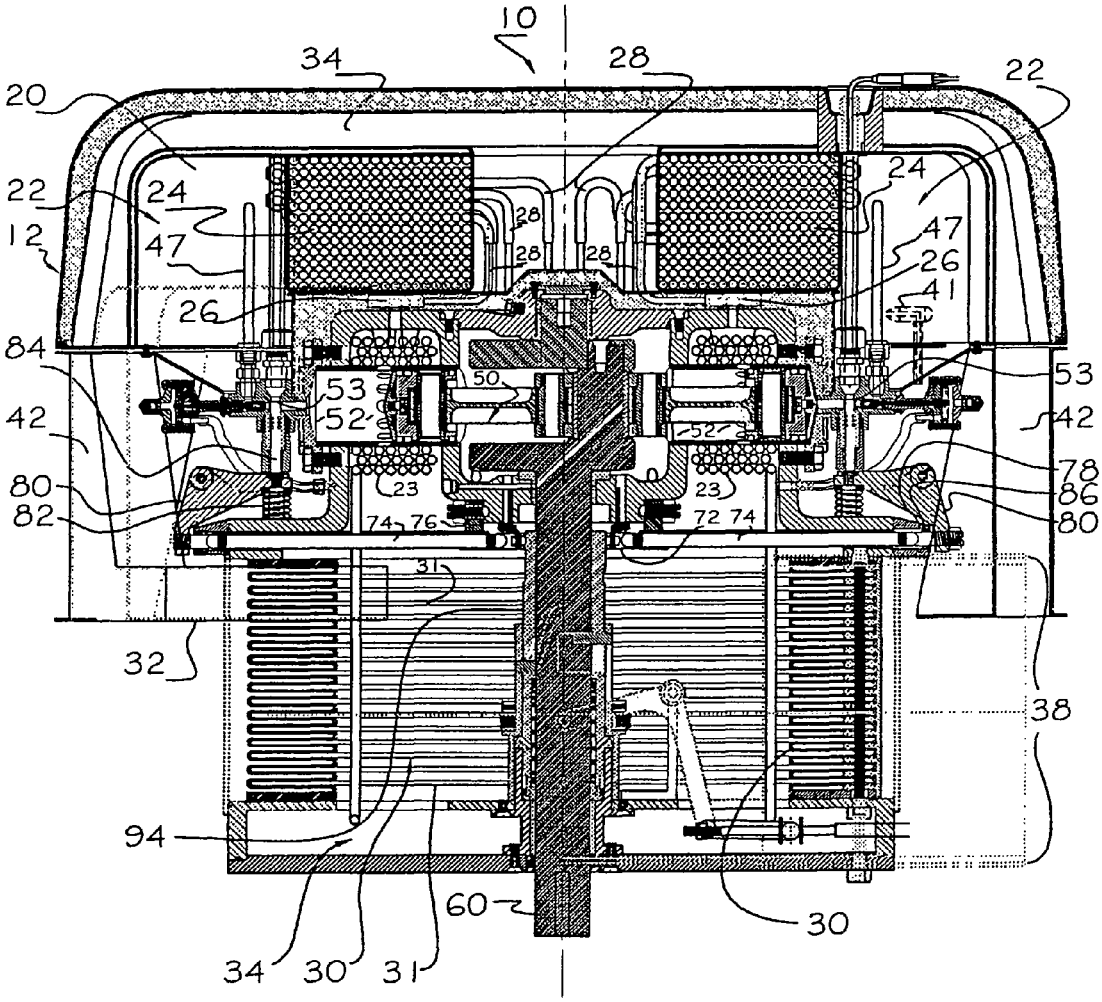
FIG. 3 is a side elevational view, shown in cross-section illustrating the principal components of the engine.
Figure 4:
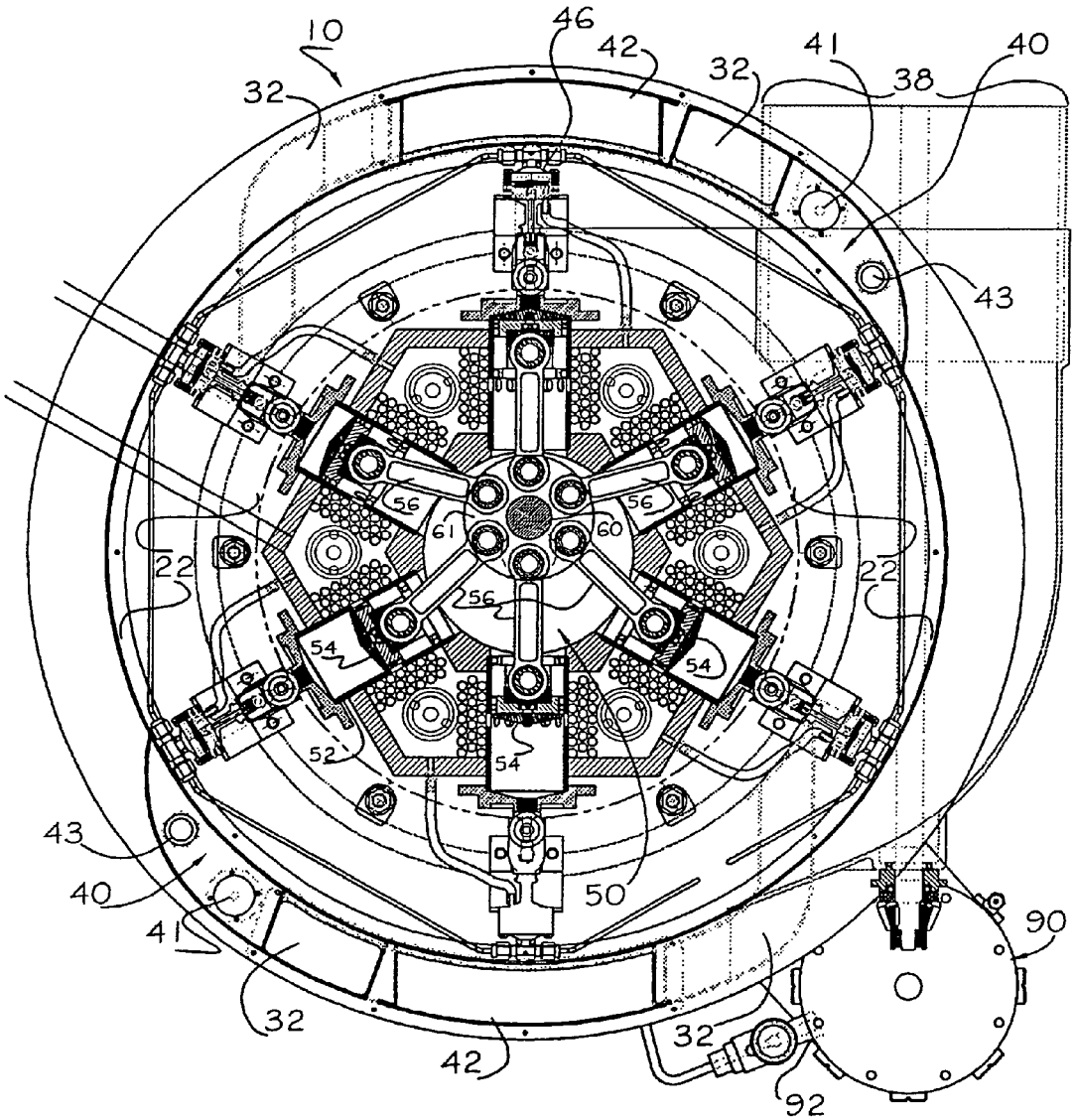
FIG. 4 is a top plan view, in partial cross-section, taken along the plane of the line 4-4 in FIG. 3.

In the next phase, the air is directed through heat exchangers 42 where the air is heated prior to entering the steam generator 20 (see FIGS. 2 and 3). In the steam generator 20, the preheated air is mixed with fuel from a fuel atomizer 41 (See FIG. 8). An igniter 43 burns the atomized fuel in a centrifuge, causing the heavy fuel elements to move towards the outer sides of the combustion chamber 22 where they are consumed. The combustion chamber 22 is arranged in the form of a cylinder which encloses a circularly wound coil of densely bundled tubes 24 forming a portion of the steam supply lines leading to the respective cylinders. The bundled tubes 24 are heated by the burning fuel of the combustion nozzle burner assembly 40 comprising the air blowers 38, fuel atomizer 41, and the igniter 43 (see FIG. 4). The burners 40 are mounted on opposed sides of the circular combustion chamber wall and are aligned to direct their flames in a spiral direction. By spinning the flame front around the combustion chamber, the coil of tubes 24 is repetitively 'washed' by the heat of this combustion gas which circulates in a motion to the center of the tube bundle 24. Temperatures in the tube bundle 24 are maintained at approximately 1,200 degrees Fahrenheit. The tube bundle 24 carries the steam and is exposed to the high temperatures of combustion, where the steam is superheated and maintained at a pressure of approximately 3,200 psi. The hot gas exits through an aperture located at the top center of the round roof of the cylindrical combustion chamber. The centrifugal motion of the combustion gases causes the heavier, unburned particles suspended in the gases to accumulate on the outer wall of the combustion chamber where they are incinerated, contributing to a cleaner exhaust. This cyclonic circulation of combustion gases within the combustion chamber creates higher efficiency in the engine. Specifically, multiple passes of the coil of tubes 24 allows for promoting greater heat saturation relative to the amount of fuel expended. Moreover, the shape of the circularly wound bundle of tubes permits greater lengths of tube to be enclosed within a combustion chamber of limited dimensions than within that of a conventional boiler. Furthermore, by dividing each cylinder's steam supply line into two or more lines at entry to the combustion chamber (i.e. in the tube bundle), a greater tube surface area is exposed to the combustion gases, promoting greater heat transfer so that the fluid can be heated to higher temperatures and pressures which further improves the efficiency of the engine.

Figure 12:
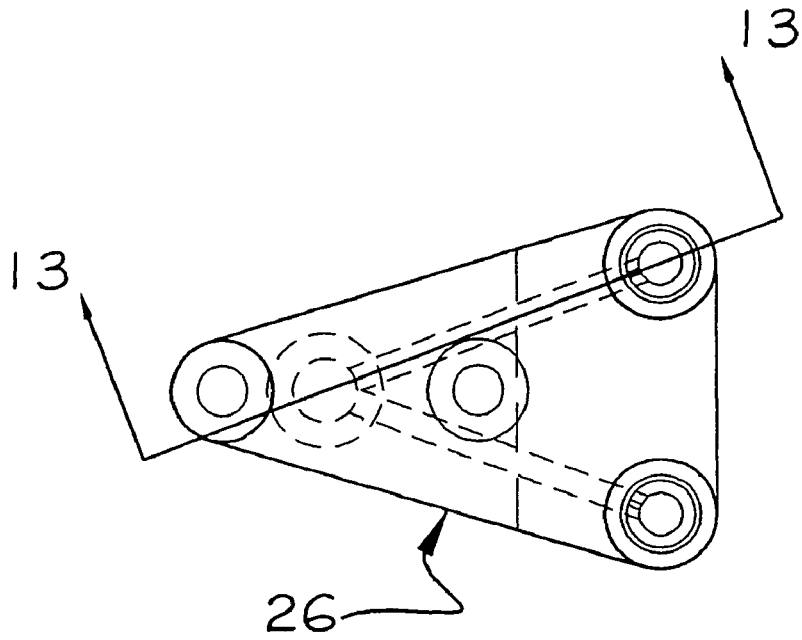
FIG. 12 is a top plan view of a splitter valve.
Figure 13:
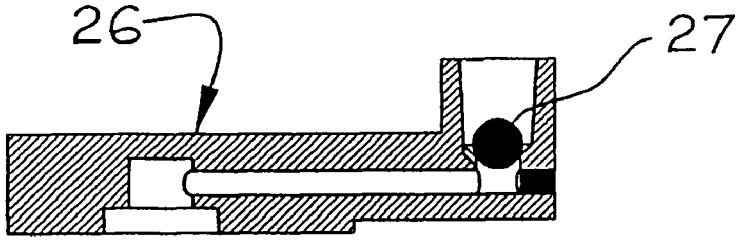
FIG. 13 is a cross-sectional view of the splitter valve taken along line 13-13 in a FIG. 12 illustrating a flow control valve in the splitter.
Figure 14:
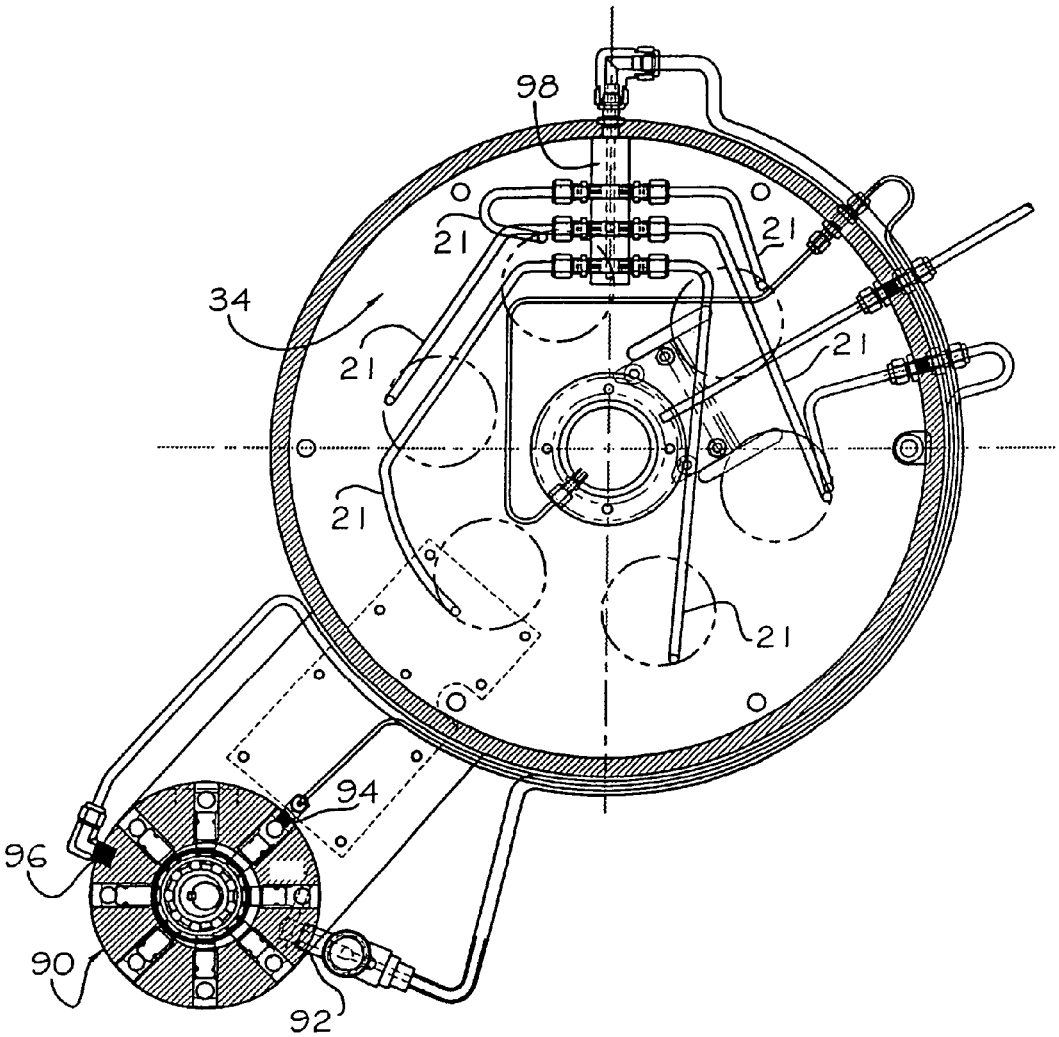
FIG. 14 is a top plan view, in partial cut-away, showing a poly-phase primary pump and manifold for the lower and high pressure pump systems of the engine.

As the water exits the single line 21 of each individual cylinder's pre-heating coil on its way to the combustion chamber, it branches into the two or more lines 28 per cylinder forming part of the tube bundle which consists of a coiled bundle 24 of all these branched lines 28 for all cylinders, as described above. As seen in FIG. 3, these multiple lines 28 are identical in cross sectional areas and lengths. While such equalization of volumes and capacities between the single 'feeder' line 21 and the branched lines 28 would be balanced under static conditions, under the dynamic conditions of super-critical high temperatures and high pressures, comparative flow in the branch lines can become unbalanced leading to potential overheating and possible wall failure in the pipe with lower flow. The splitter valve 26, located at the juncture of the single line 21 to the multiple lines 28, equalizes the flow between the branch lines (see FIGS. 3, 12 and 13). The splitter valve 26 minimizes turbulence at the juncture by forming not a right angle 'T' intersection, but a 'Y' intersection with a narrow apex. The body of this 'Y' junction contains flow control valves 27 that allow unimpeded flow of fluid towards the steam generator 20 through each of the branch lines 28, but permit any incremental over-pressure in one line to 'bleed' back to the over pressure valve (pressure regulator) 46 to prevent over-pressuring the system.

Figure 5:
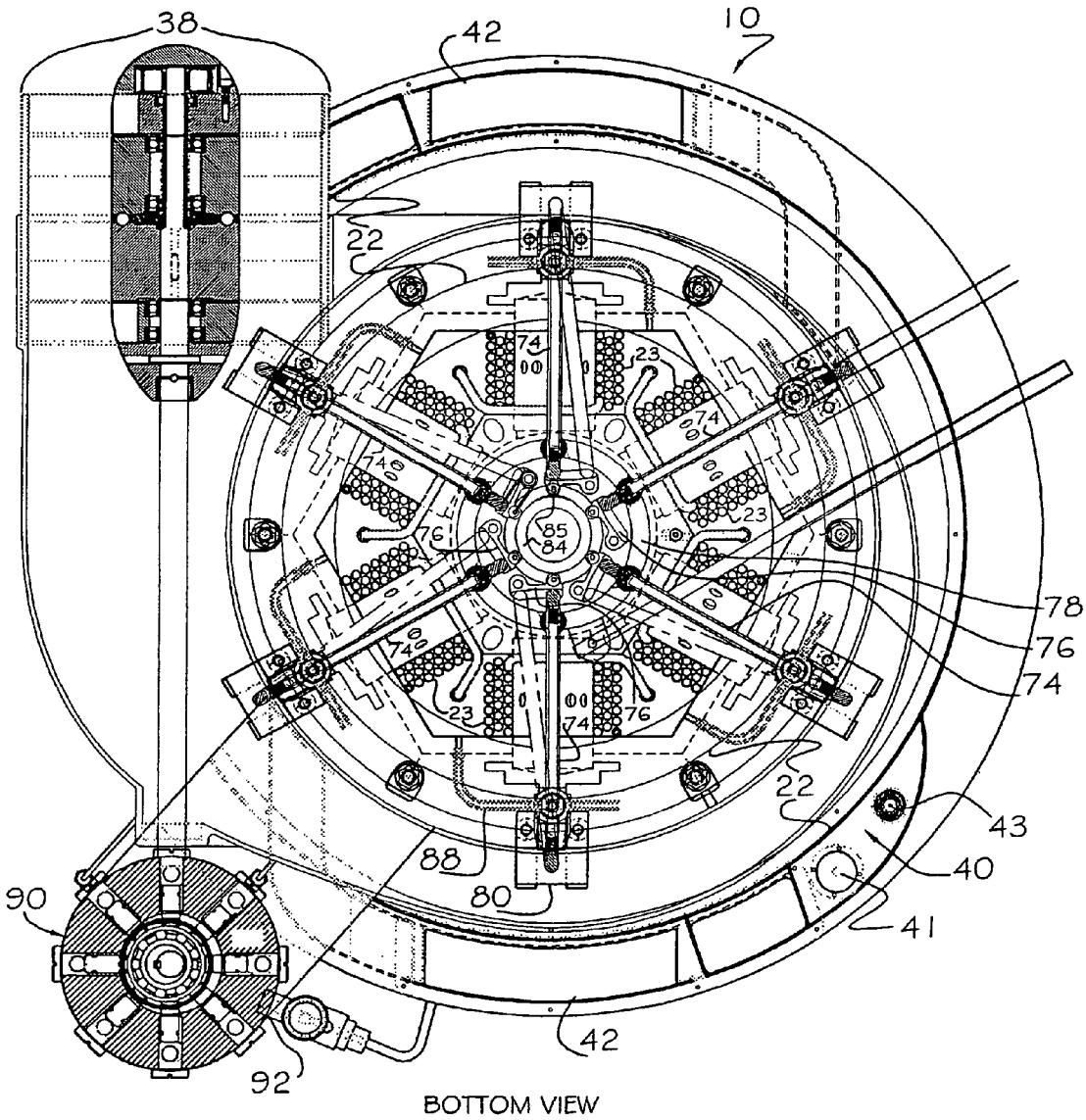
FIG. 5 is a top plan view, in partial cross-section, taken along the plane of the line 5-5 in FIG. 3.
Figure 6:
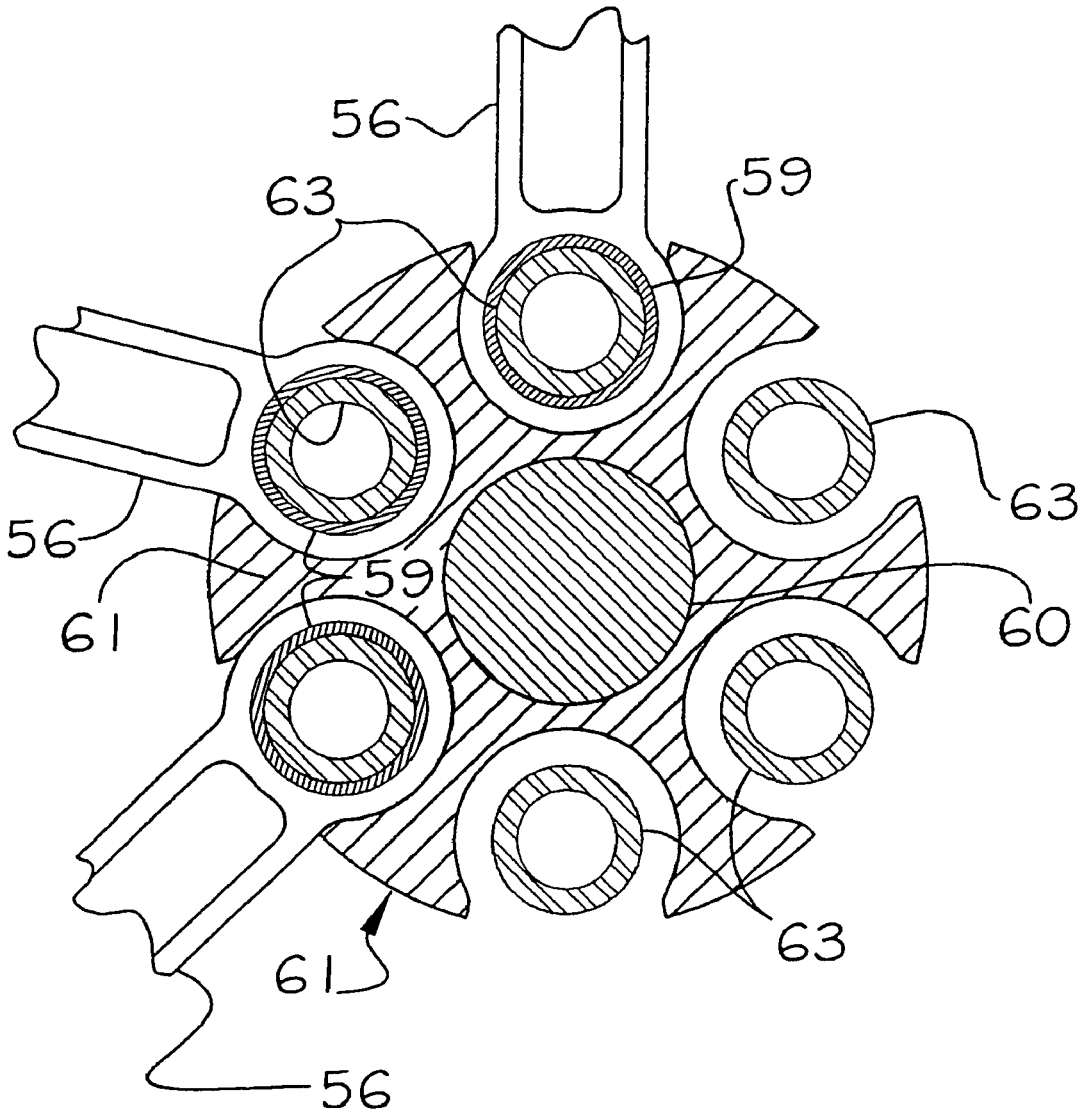
FIG. 6 is an isolated top plan view of a crank disk assembly.
Figure 8:
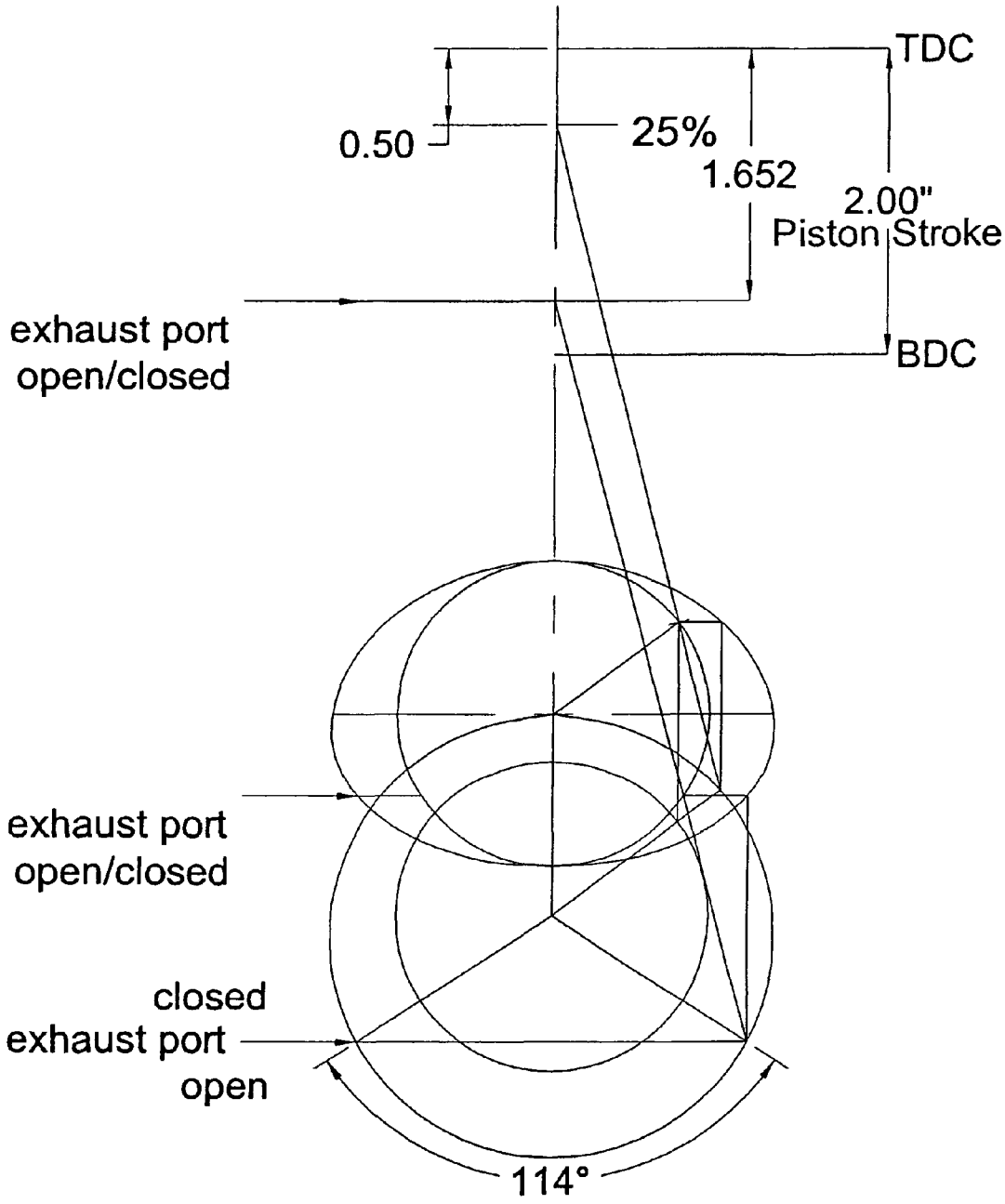
FIG. 8 is a power stroke diagram.

As best seen in FIG. 5, the cylinders 52 of the engine are arranged in a radial configuration with the cylinder heads 51 and valves 53 extending into the cyclone furnace. A cam 70 moves push-rods 74 (see FIG. 5) to control opening of steam injection valves 53. At higher engine speeds, the steam injection valves 53 are fully opened to inject steam into the cylinders 52, causing piston heads 54 to be pushed radially inward. Movement of the piston heads 54 causes connecting rods 56 to move radially inward to rotate crank disk 61 and crankshaft 60. As shown in FIG. 6, each connecting rod 56 connects to the crank disk 61. More specifically, the inner circular surface of the connecting rod link is fitted with a bearing ring 59 for engagement about hub 63 on the crank disk 61. In a preferred embodiment, the crank disk 61 is formed of a bearing material which surrounds the outer surface of the connecting rod link, thereby providing a double-backed bearing to carry the piston load. The connecting rods 56 are driven by this crank disk 61. These rods are mounted at equal intervals around the periphery of this circular bearing. The lower portions of the double-backed bearings joining the piston connecting rods to the crank disk 61 are designed to limit the angular deflection of the connecting rods 56 so that clearance is maintained between all six connecting rods during one full rotation of the crankshaft 60. The center of the crank disk 61 is yoked to a single crankshaft journal 62 that is offset from the central axis of the crankshaft 60. While the bottom ends of the connecting rods 56 rotate in a circle about the crank disk 61, the offset of the crank journal 62 on which the crank disk 61 rides creates a geometry that makes the resultant rotation of these rods travel about an elliptical path. This unique geometry confers two advantages to the operation of the engine. First, during the power stroke of each piston, its connecting rod is in vertical alignment with the motion of the driving piston thereby transferring the full force of the stroke. Second, the offset between the connecting rods 56 and the crank disk 61, the offset between the crank disk and the crank journal 62, and the offset of the crank journal 62 to the crankshaft 60 itself, combine to create a lever arm that amplifies the force of each individual power stroke without increasing the distance the piston travels. A diagram showing this unique power stroke is shown in FIG. 8. Accordingly, the mechanical efficiency is enhanced. This arrangement also provides increased time for steam admission and exhaust.

Figure 7:
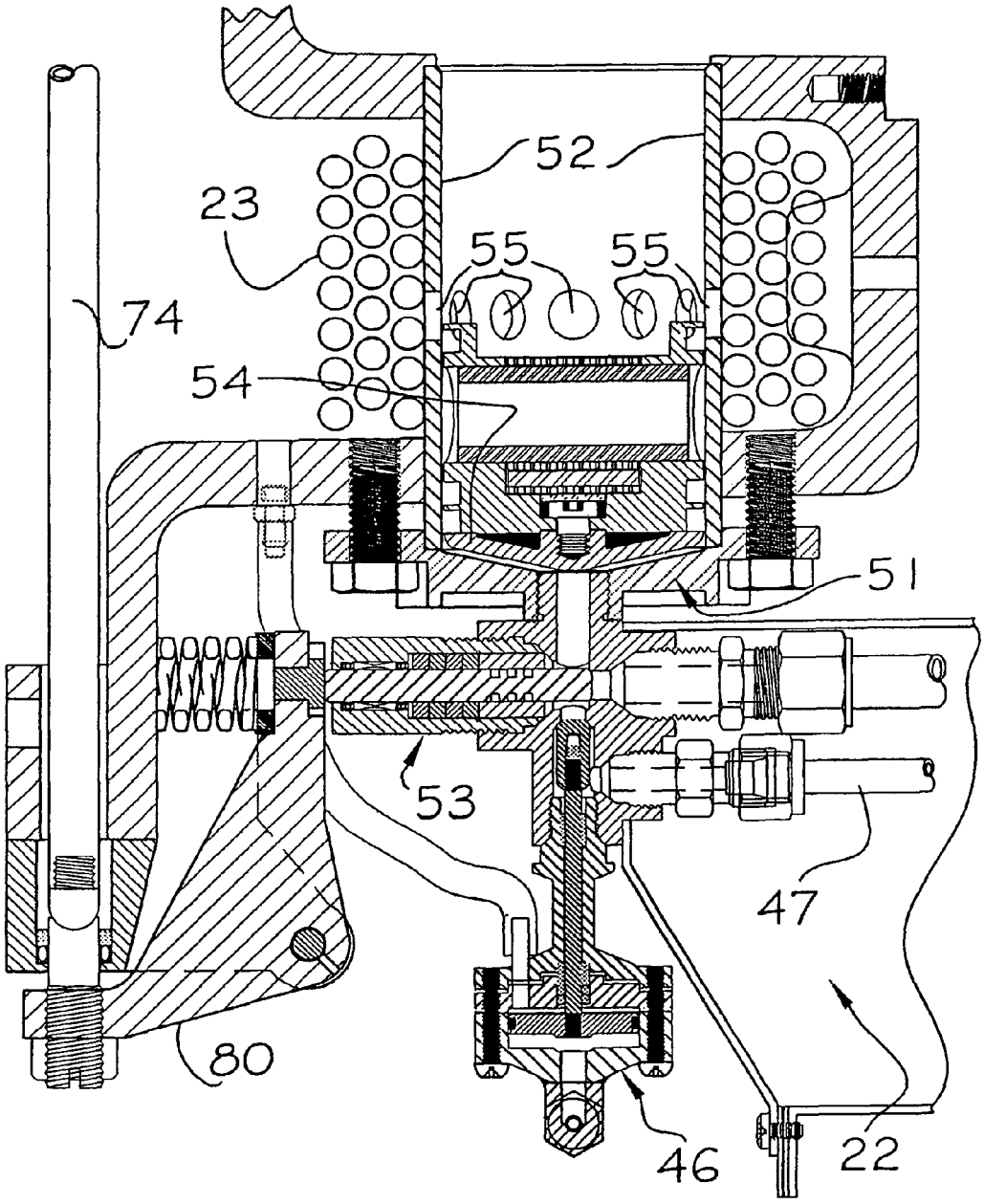
FIG. 7 is an isolated cross-sectional view showing a compression relief valve assembly, injection valve assembly and cylinder head.

Referring to FIG. 7, at lower engine speeds the steam injection valves 53 are partially closed and a clearance volume compression release valve 46 is opened to release steam from the cylinders 52. The clearance volume valves 46 are controlled by the engine RPM's. The clearance volume valve 46 is an innovation that improves the efficiency of the engine at both low and high speeds. Minimizing the clearance volume in a cylinder 52 is advantageous for efficiency as it lessens the amount of super-heated steam required to fill the volume, reduces the vapor contact area which absorbs heat that would otherwise be used in the explosive expansion of the power stroke, and, by creating higher compression in the smaller chamber, further raises the temperature of the admitted steam. However, the higher compression resulting from the smaller volume has the adverse effect at low engine RPM of creating back pressure against the incoming charge of super-heated steam. The purpose of the clearance volume valve 46 is to reduce the cylinder compression at lower engine RPMs, while maintaining higher compression at faster piston speeds where the back pressure effect is minimal. The clearance volume valve 46 controls the inlet to a tube 47 that extends from the cylinder into the combustion chamber 22. It is hydraulically operated by a lower pressure pump system of engine-driven primary poly-phase water pump 90. At lower RPM, the clearance volume valve 46 opens the tube 47. By adding the incremental volume of this tube 47 to that of the cylinder 52, the total clearance volume is increased with a consequent lowering of the compression. The vapor charge flowing into the tube is additionally heated by the combustion chamber 22 which surrounds the sealed tube 47, vaporizing back into the cylinder 52 where it contributes to the total vapor expansion of the low speed power stroke. At higher RPM, the pump system of the engine-driven pump 90 that hydraulically actuates the clearance volume valve, develops the pressure to close the clearance volume valve 46 thereby, reducing the total clearance volume, and raising the cylinder compression for efficient higher speed operation of the engine. The clearance volume valves 46 contribute to the efficiency of the engine at both low and high speed operation.

Steam under super-critical pressure is admitted to the cylinders 52 of the engine by a mechanically linked throttle mechanism acting on the steam injection needle valve 53. To withstand the 1,200° Fahrenheit temperatures, the needle valves 53 are water cooled at the bottom of their stems by water piped from and returned to the condenser 30 by a water lubrication pump 96. Along the middle of the valve stems, a series of labyrinth seals, or grooves in the valve stem, in conjunction with packing rings and lower lip seals, create a seal between each valve stem and a bushing within which the valve moves. This seals and separates the coolant flowing past the top of the valve stem and the approximate 3,200 lbs. psi pressure that is encountered at the head and seat of each valve. Removal of this valve 53, as well as adjustment for its seating clearance, can be made by threads machined in the upper body of the valve assembly. The needle valve 53 admitting the super-heated steam is positively closed by a spring 82 within each valve rocker arm 80 that is mounted to the periphery of the engine casing. Each spring 82 exerts enough pressure to keep the valve 53 closed during static conditions.

The motion to open each valve is initiated by a crankshaft-mounted cam ring 84. A lobe 85 on the cam ring forces a throttle follower 76 to 'bump' a single pushrod 74 per cylinder 52. Each pushrod 74 extends from near the center of the radially configured six cylinder engine outward to the needle valve rocker 80. The force of the throttle follower 76 on the pushrod 74 overcomes the spring closure pressure and opens the valve 53. Contact between the follower, the rocker arm 80, and the pushrod 74 is determined by a threaded adjustment socket mounted on each needle valve rocker arm 80.

Throttle control on the engine is achieved by varying the distance each pushrod 74 is extended, with further extension opening the needle valve a greater amount to admit more super-heated fluid. All six rods 74 pass through a throttle control ring 78 that rotates in an arc, displacing where the inner end of each pushrod 74 rests on the arm of each cam follower (see FIG. 5). Unless the follower 76 is raised by the cam lobe 85, all positions along the follower where the pushrod 74 rests are equally 'closed'. As the arc of the throttle ring 78 is shifted, the resting point of the pushrod 74 shifts the lever arm further out and away from the fulcrum of the follower. When the follower 76 is bumped by the cam lobe 85, the arc distance that the arm traverses is magnified, thereby driving the pushrod 74 further, and thus opening the needle valve 53 further. A single lever attached to the throttle ring 78 and extending to the outside of the engine casing is used to shift the arc of the throttle ring, and thus becomes the engine throttle.

Figure 9:
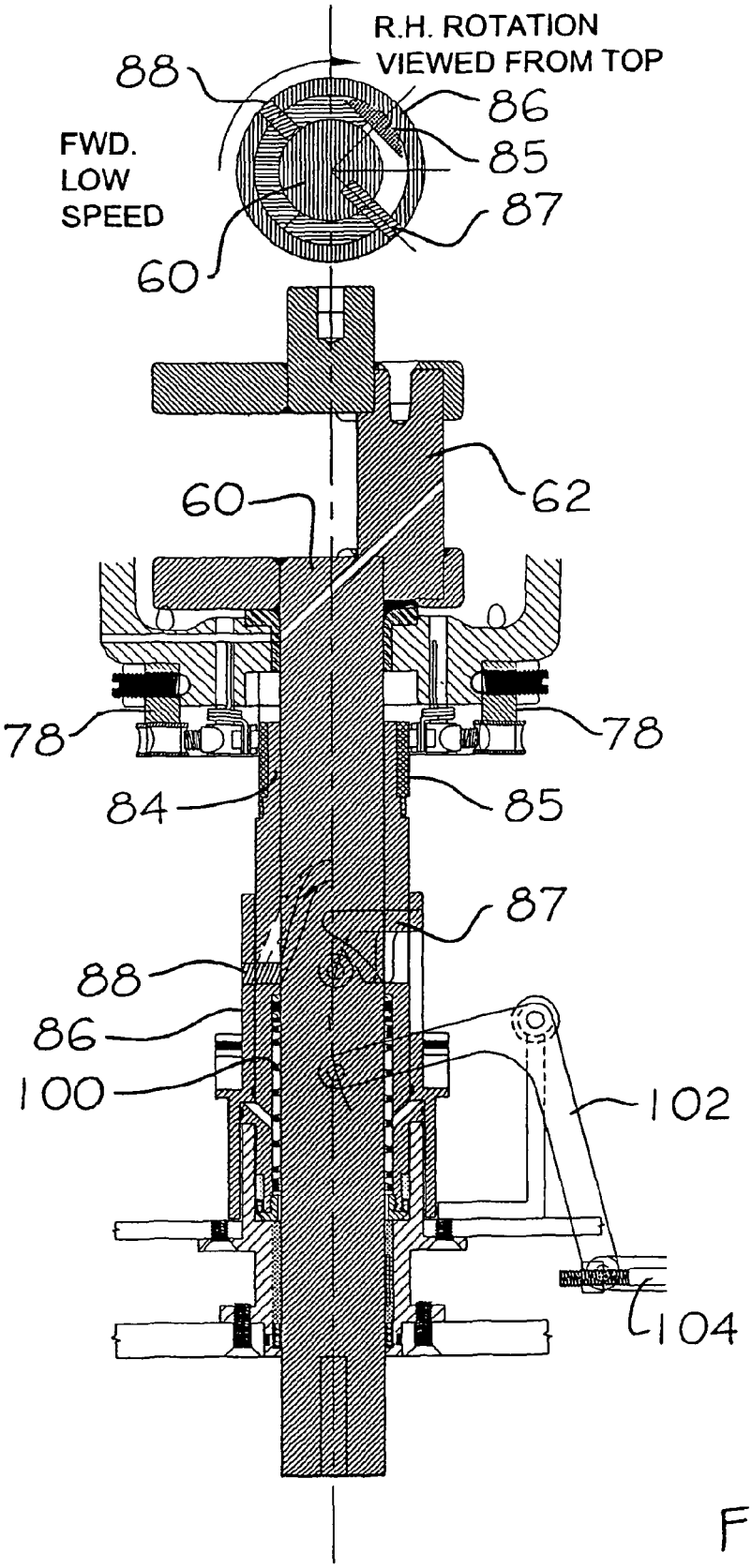
FIG. 9 is a cross-sectional view of a throttle control and engine timing control assembly engaged in a forward direction at low speed.
Figure 10:
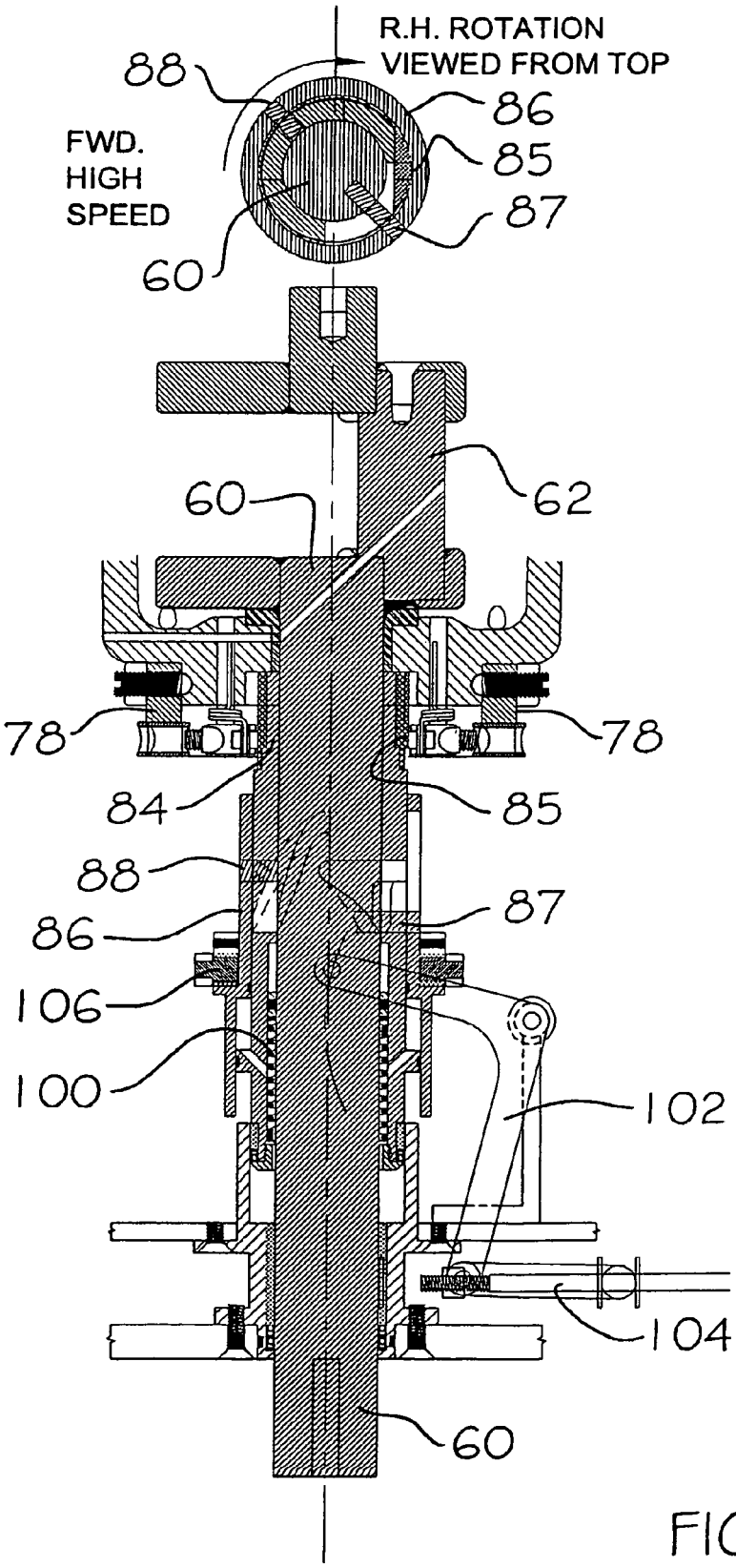
FIG. 10 is a cross-sectional view of the throttle control and engine timing control assembly engaged in a forward direction at high speed.
Figure 11:
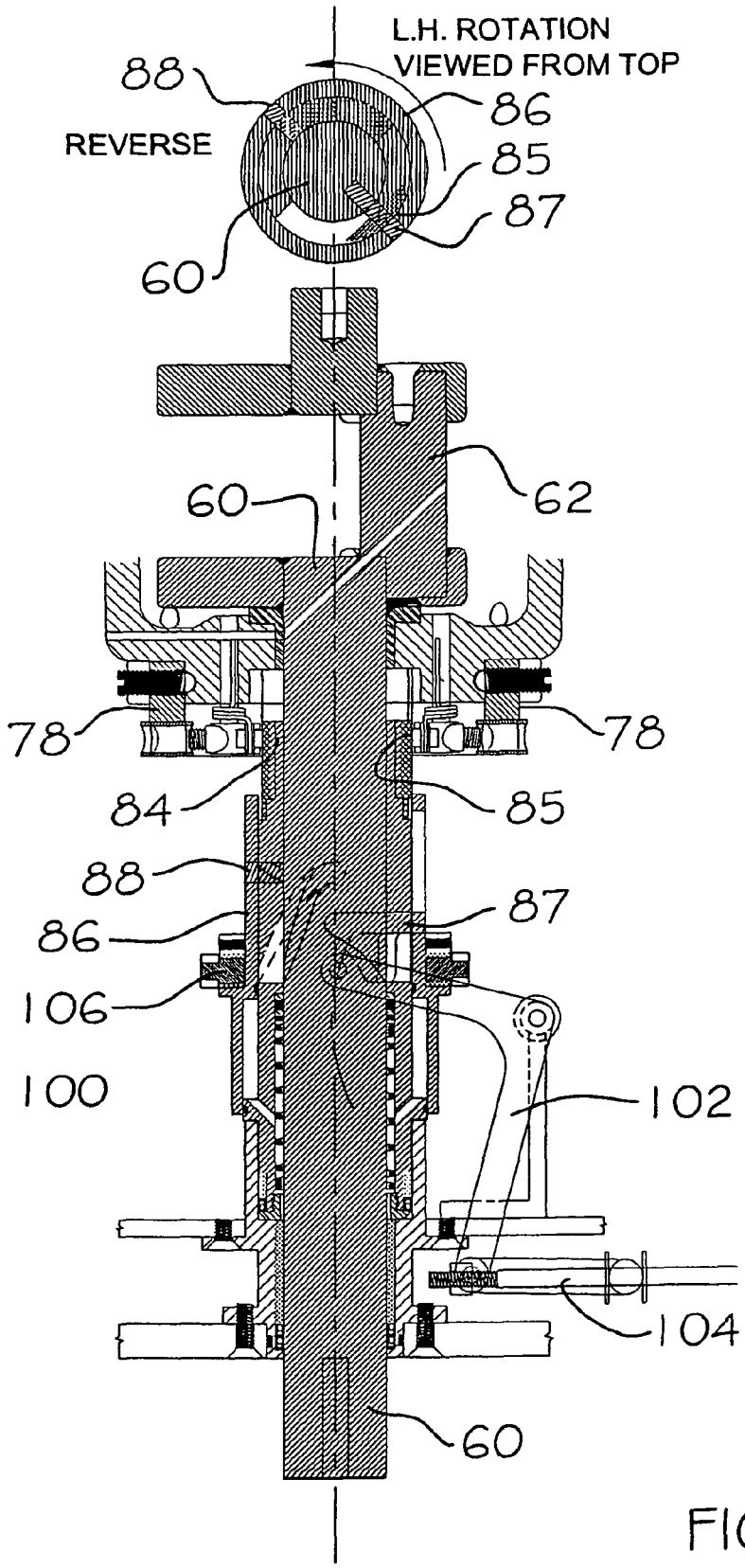
FIG. 11 is a cross-sectional view of the throttle control and engine timing control assembly engaged in a reverse direction.

Referring to FIGS. 9-11, timing control of the engine is achieved by moving the cam ring 84. Timing control advances the moment super-heated fluid is injected into each piston and shortens the duration of this injection as engine RPMs increase. 'Upward' movement of the cam ring 84 towards the crankshaft journal 62 alters the timing duration by exposing the follower 76 to a lower portion of the cam ring 84 where the profile of the lobe 85 of the cam is progressively reduced. Rotating this same cam ring 84 alters the timing of when the cam lobe triggers steam injection to the cylinder(s). Rotation of the cam ring is achieved by a sleeve cam pin 88 that is fixed to the cam sleeve 86. The cam pin 88 extends through a curvilinear vertical slot in the cam ring 84, so that as the cam ring 84 rises, by hydraulic pressure, a twisting action occurs between the cam ring 84 and cam sleeve piston 86 wherein the cam ring 84 and lobe 85 partially rotate. These two movements of the cam ring are actuated by the cam sleeve piston 86 that is sealed to and spins with the crankshaft 60. More specifically, a crankshaft cam pin 87 that is fixed to the crankshaft 60 passes through an opening in the cam ring and a vertical slot on the cam sleeve piston. This allows vertical (i.e. longitudinal) movement of the cam ring 84 and the cam sleeve 86 relative to the crankshaft, but prevents relative rotation between the cam sleeve 86 and crankshaft 60 (due to the vertical slot), so that the cam sleeve 86 spins with the crankshaft. A crankshaft driven water pump system provides hydraulic pressure to extend this cam sleeve piston 86. As engine RPMs increase, the hydraulic pressure rises. This extends the cam sleeve piston 86 and raises the cam ring 84, thereby exposing the higher RPM profiles on the lobe 85 to the cam follower(s) 76. Reduced engine speeds correspondingly reduce the hydraulic pressure on the cam sleeve piston 86, and a sealed coil spring 100 retracts the cam sleeve piston 86 and the cam ring 84 itself.

The normal position for the throttle controller is forward slow speed. As the throttle ring 78 admits steam to the piston, the crank begins to rotate in a slow forward rotation. The long duration of the cam lobe 85 allows for steam admission into the cylinders 52 for a longer period of time. As previously described, the elliptical path of the connecting rods creates a high degree of torque, while the steam admission into the cylinder is for a longer period of time and over a longer lever arm, into the phase of the next cylinder, thereby allowing a self starting movement.

As the throttle ring 78 is advanced, more steam is admitted to the cylinder, allowing an increase in RPM. When the RPM increases, the pump 90 supplies hydraulic pressure to lift the cam ring 84 to high speed forward. The cam ring 84 moves in two phases, jacking up the cam to decrease the cam lobe duration and advance the cam timing. This occurs gradually as the RPM's are increased to a pre-determined position. The shift lever 102 is spring loaded on the shifting rod 104 to allow the sleeve 86 to lift the cam ring 84.

To reverse the engine, it must be stopped by closing the throttle. Reversing the engine is not accomplished by selecting transmission gears, but is done by altering the timing. More specifically, reversing the engine is accomplished by pushing the shift rod 104 to lift the cam sleeve 86 up the crankshaft 60 as the sleeve cam pin 88 travels in a spiraling groove in the cam ring causing the crank to advance the cam past top dead center. The engine will now run in reverse as the piston pushes the crank disk at an angle relative to the crankshaft in the direction of reverse rotation. This shifting movement moves only the timing and not the duration of the cam lobe to valve opening. This will give full torque and self-starting in reverse. High speed is not necessary in reverse.

Exhaust steam is directed through a primary coil which also serves to preheat the water in the generator 20. The exhaust steam is then directed through the condenser 30, in a centrifugal system of compressive condensation. As described above, the cooling air circulates through the flat plates, is heated in an exhaust heat exchanger 42 and is directed into the burner 40. This reheat cycle of air greatly adds to the efficiency and compactness of the engine.

The water delivery requirements of the engine are served by a poly-phase pump 90 that comprises three pressure pump systems. One is a high pressure pump system 92 mounted adjacently within the same housing. A medium pressure pump system 94 supplies the water pressure to activate the clearance volume valve and the water pressure to operate the cam timing mechanism. A lower pressure pump system 96 provides lubrication and cooling to the engine. The high pressure unit pumps water from the condenser sump 34 through six individual lines 21, past the coils of the combustion chamber 22 to each of the six needle valves 53 that provide the super-heated fluid to the power head of the engine. This high pressure section of the poly-phase pump 90 contains radially arranged pistons that closely resemble the configuration of the larger power head of the engine. The water delivery line coming off each of the water pump pistons is connected by a manifold 98 that connects to a regulator shared by all six delivery lines that acts to equalize and regulate the water delivery pressure to the six pistons of the power head. All regulate the water delivery pressure to the six pistons of the power head. All pumping sub units within the poly-phase pump are driven by a central shaft. This pump drive shaft is connected to the main engine crankshaft 60 by a mechanical coupler. When the engine is stopped, an auxiliary electric motor pumps the water, maintaining the water pressure necessary to restarting the engine.

While the present invention has been shown and described in accordance with a preferred and practical embodiment thereof, it is recognized that departures from the instant disclosure are contemplated within the spirit and scope of the present invention.

LIST OF COMPONENTS

10. Engine
12. Engine Shroud
20. Steam Generator
21. Steam Supply Line (Feeder Line)
22. Combustion Chamber/Cyclone Furnace
23. Pre-Heating Coil Around Each Cylinder
24. Tube Bundle (Coil of Tubes) Consisting Of Branch Lines For All Cylinders
26. Splitter Valve
27. Flow Control Valves
28. Branch lines split from main feeder line
30. Condenser
31. Flat plates
32. Air Intake Transfer Ducts
34. Sump/Condensate Collection Pan
38. Blowers
40. Combustion Nozzle Fuel Burner
41. Fuel Atomizer
42. Heat Exchangers
43. Igniter
46. Compression Release Clearance Volume Valve
47. Clearance Volume Tubes
50. Main Engine Assembly
51. Cylinder Heads
52. Cylinders
53. Steam Injection Valves
54. Piston Heads
55. Exhaust Ports On Cylinders
56. Connecting Rods
59. Bearing Ring on Inside of Connecting Rod Link
60. Crankshaft
61. Crank Disk
62. Crankshaft Journal
63. Hub on Crank Disk for Attaching Connecting Rod
70. Cam
74. Pushrods
76. Throttle Follower
78. Throttle Control Ring
80. Rockers Arms
82. Spring on Rocker Arms
84. Cam Ring
85. Lobe on Cam Ring
86. Cam Sleeve Piston
87. Crankshaft Cam Pin
88. Sleeve Cam Pin
90. Primary Poly-Phase Pump
92. High Pressure Pump System
94. Medium Pressure Pump System
96. Low Pressure Pump System
98. Pump Manifold
100. Coil Spring to Retreat Cam Sleeve Piston
102. Shift Lever
104. Shifting Rod
106. Shifting Collar

What is claim is:

1. An engine comprising:
a condenser for condensing steam into a liquid condensate;
a sump for collecting the liquid condensate;
a steam generator including at least one burner adapted to burn a supplied fuel, and a combustion chamber communicating with said at least one burner for generating heat within said combustion chamber from the burning of the supplied fuel;
a main engine drive assembly comprising:
at least one cylinder;
a piston movably captivated within said cylinder and including a piston head structured and disposed for sealed, reciprocating movement within said cylinder;
a crankshaft;
a crank cam fixed to said crankshaft and rotatable therewith;
a connecting rod pivotally connected between said piston and said crank cam;
an injector valve operable between a closed position and an open position to release a pressurized charge of steam into a top portion of said cylinder;
a steam line for delivering steam to said injector valve for injection into said cylinder upon momentary opening of said injector valve;
a pump for pumping water from said sump and through said steam line;
said steam line including a section within said combustion chamber, and said section having an exposed surface area within said combustion chamber for allowing heat transfer from an exterior of said steam line to an interior of said steam line in order to heat the water traveling therethrough and to change phase of the water within said steam line from liquid to steam for delivery to said injector valve; and
an exhaust transfer passage for delivering exhaust steam from said at least one cylinder to said condenser, wherein the exhaust steam changes phase into liquid prior to collection within said sump; and
at least one heat exchanger for heating the water in said steam line before entering said section of said steam line within said combustion chamber, and said at least one heat exchanger using heat from the exhaust steam that is exhausted from said at least one cylinder.

2. The engine as recited in claim 1 wherein said main engine drive assembly further comprises:
a plurality of said cylinders each having said piston and said piston head movably captivated therein;
a plurality of connecting rods each pivotally connected to said piston of a respective one of said plurality of cylinders; and
a plurality of injector valves, each of said plurality of injector valves being operatively positioned to release the pressurized charge of steam into a respective one of said plurality of cylinders upon being operated to said open position.

3. The engine as recited in claim 2 wherein said steam generator comprises:
at least one blower for supplying a flow of air into said combustion chamber.

4. The engine as recited in claim 3 wherein said at least one burner of said steam generator comprises:
a fuel atomizer for directing the supplied fuel in an atomized mist into the flow of air; and
an igniter for igniting the atomized mist of fuel.

5. The engine as recited in claim 2 wherein said section of said steam line includes a plurality of branch lines within said combustion chamber.

6. The engine as recited in claim 5 further comprising:
a splitter valve at a juncture of a single line portion of said steam line and said branch lines, said splitter valve being structured and disposed for equalizing flow pressure of the steam among the plurality of branch lines.

7. The engine as recited in claim 2 wherein said plurality of cylinders are arranged in a radial configuration.

8. The engine as recited in claim 2 further comprising:

a plurality of clearance volume valves, each one of said clearance volume valves being operatively positioned with a respective one of said plurality of cylinders, and said clearance volume valves being structured and disposed for reducing steam compression within said cylinders at lower engine RPMs and each of said plurality of clearance volume valves being further structured and disposed for maintaining higher steam compression within said cylinders at higher engine RPMs.

9. The engine as recited in claim 1 further comprising:

a pushrod operatively engaging said injector valve; and a spring biased rocker arm operatively engaged with said pushrod for momentarily opening said injector valve.

10. The engine as recited in claim 9 further comprising:

a cam ring movably mounted on said crankshaft;

a lobe bulging outwardly from said cam ring; and a throttle follower operatively contacting said cam ring and said pushrod, said throttle follower being structured and disposed for urging said pushrod against said injector valve upon said throttle follower contacting said lobe on said cam ring to momentarily open said injector valve as said cam ring rotates.

11. An engine comprising:

a condenser including an arrangement of spaced plates providing air-cooled surfaces and a sump below the arrangement of spaced plates for collecting liquid condensate;

a combustion chamber;

a heat generating assembly for burning a supply of fuel and producing a centrifuge of hot air and flames directed within said combustion chamber;

a main engine drive assembly comprising:

at least one cylinder;

a piston movably captivated within said cylinder and including a piston head structured and disposed for sealed, reciprocating movement within said cylinder;

a crankshaft;

a crank cam fixed to said crankshaft and rotatable therewith;

a connecting rod pivotally connected between said piston and said crank cam;

an injector valve operable between a closed position and an open position to release a pressurized charge of steam into a top portion of said cylinder;

a steam line for delivering steam to said injector valve for injection into said cylinder upon momentary opening of said injector valve;

a pump for pumping water from said sump and through said steam line;

said steam line including a section directed through said combustion chamber wherein water and vapor within said section of said steam line is heated by exposure to heat within said combustion chamber to produce steam within said steam line for delivery to said injector valve and into said cylinder upon opening of said injector valve;

a first heat exchanger for pre-heating intake air prior to entering said combustion chamber, said first heat exchanger using heat from exhaust gases released from said combustion chamber; and a second heat exchanger for heating the water in said steam line before entering said section of said steam line within said combustion chamber, and said second heat exchanger using heat from steam exhausted from said at least one cylinder.

12. A method for producing power in an engine having at least one cylinder, a piston movably captivated within said cylinder and including a piston with a piston head for sealed reciprocating movement within said cylinder, a crankshaft, a crank cam fixed to said crankshaft and rotatable therewith, and a connecting rod pivotally connected between said piston and said crank cam;

said method comprising the steps of:

pumping liquid from a reservoir through one or more lines leading to an injector valve at said at least one cylinder;

generating heat in a combustion chamber by burning a fuel and air mixture and producing a centrifuge of hot air and flames within said combustion chamber;

directing a section of the one or more lines through said combustion chamber to expose the liquid pumped through the one or more lines to the heat of said combustion chamber;

producing steam within said section of the one or more lines from the heat of said combustion chamber;

injecting the steam into said cylinder and against said piston head to force said piston in a downward power stroke, thereby turning said crank cam and said crankshaft;

pre-heating intake air prior to entering said combustion chamber using heat from exhaust gases exiting said combustion chamber;

directing exhaust steam from said cylinder into a condenser;

preheating the liquid in the one or more lines before reaching said combustion chamber using heat from the exhaust steam that is exhausted from said cylinder;

condensing the exhaust steam to produce liquid; and directing the liquid into said reservoir.

* * * * *